US006257929B1

(12) United States Patent
Wang

(10) Patent No.: US 6,257,929 B1
(45) Date of Patent: Jul. 10, 2001

(54) SHIELDED CONNECTOR ASSEMBLY

(75) Inventor: Wei-Che Wang, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/472,738

(22) Filed: Dec. 27, 1999

(51) Int. Cl.[7] ..... H01R 13/648
(52) U.S. Cl. ..... 439/607
(58) Field of Search ..... 439/607–610

(56) References Cited

U.S. PATENT DOCUMENTS 5,660,558 * 8/1997 Osanai et al. ..... 439/607
5,725,386 * 3/1998 Davis et al. ..... 439/607
5,785,557 * 7/1998 Davis ..... 439/607
5,921,814 * 7/1999 Maruyama ..... 439/607

* cited by examiner

*Primary Examiner*—Gary F. Paumen
(74) *Attorney, Agent, or Firm*—Wei Te Chung

(57) ABSTRACT

A shielded connector assembly comprises an insulative housing retaining a plurality of contacts therein, a contact spacer and an outer shell. The housing forms a pair of flexible hooks on each of opposite upper and lower sides thereof. Each flexible hook extends in a direction parallel to the direction of assembly in which the shell engages with the housing. The shell defines a pair of engaging openings in each longitudinal side thereof corresponding to the flexible hooks of the housing. When the shell is assembled to the housing, the engaging openings of the shell come into engagement with the corresponding flexible hooks of the housing in the mating direction. Thus, the shell firmly engages with the housing without an outward deflection thereof due to the flexibility of the flexible hooks of the housing.

1 Claim, 3 Drawing Sheets

SHIELDED CONNECTOR ASSEMBLY

FIELD OF THE INVENTION

The present invention relates to an electrical connector assembly, and particular to a shielded connector assembly which ensures a reliable and convenient assembly of a shielding shell and a housing thereof.

BACKGROUND OF THE INVENTION

Electrical connectors are commonly shielded to prevent signals transmitted therethrough from being adversely affected by exterior electromagnetic interference (EMI). An outer shell is usually used as a shield as shown in U.S. Pat. Nos. 5,125,853 and 5,304,069 as well as in Taiwan Patent Application Nos. 84207642 and 81210869.

Referring to FIG. 3, a conventional electrical connector assembly 6 comprises an insulative housing 60 retaining a plurality of terminals 64 therein, a contact spacer 61, a shield 62 and a means for attaching the connector assembly 6 to other related elements. A plurality of engaging projections 602, 604 is formed on opposite upper and lower sides of the housing 60. A plurality of engaging tabs 620, 622 extends rearwards from the shield 62 corresponding to the engaging projections 602, 604 of the housing 60. An engaging opening 621, 623 is defined in each engaging tab 620, 622 of the shield 62, respectively, for engaging with the corresponding engaging projections 602, 604 of the housing 60 thereby mounting the shield 62 to the housing 60.

However, since the engaging projections 602, 604 of the housing 60 have no flexibility in themselves, they are not easy to engage with the engaging tabs 620, 622. The engaging tabs 620, 623 first need to be deflected outward for engaging with the engaging projections 602, 604. Consequently, the engagement between the engaging projections 602, 604 and engaging tabs 620, 623 are loosed and prone to disengage from each other, thereby resulting in poor shielding thereof.

Therefore, an improvement in the engagement between a shield and a housing of a connector assembly is desired.

BRIEF SUMMARY OF THE INVENTION

A main object of the present invention is to provide a shielded connector assembly ensuring good shielding protection thereof.

Another object of the present invention is to provide a shielded connector assembly which achieves good shielding protection by employing a reliable engagement between a shield and a housing thereof.

A shielded connector assembly in accordance with the present invention comprises an insulative housing retaining a plurality of contacts therein, a contact spacer and an outer shell. The housing forms a pair of flexible hooks on each of opposite longitudinal sides thereof. Each flexible hook extends in a direction parallel to the direction of assembly in which the shell engages with the housing. The shell defines a pair of engaging openings in each longitudinal side thereof corresponding to the flexible hooks of the housing. When the shell to assembled to the housing, the engaging openings of the shell come into engagement with the corresponding flexible hooks of the housing in the mating direction. Thus, the shell firmly engages with the housing without an outward deflection thereof due to the flexibility of the flexible hooks of the housing. Consequently, the engagement between the shell and the housing is tight as opposed to the loosen engagement of the prior art.

Other objects, advantages and novel features of the invention will become more apparent from the following detailed description when taken in conjunction with the accompanying drawings.

DETAILED DESCRIPTION OF THE INVENTION

Figure 1:
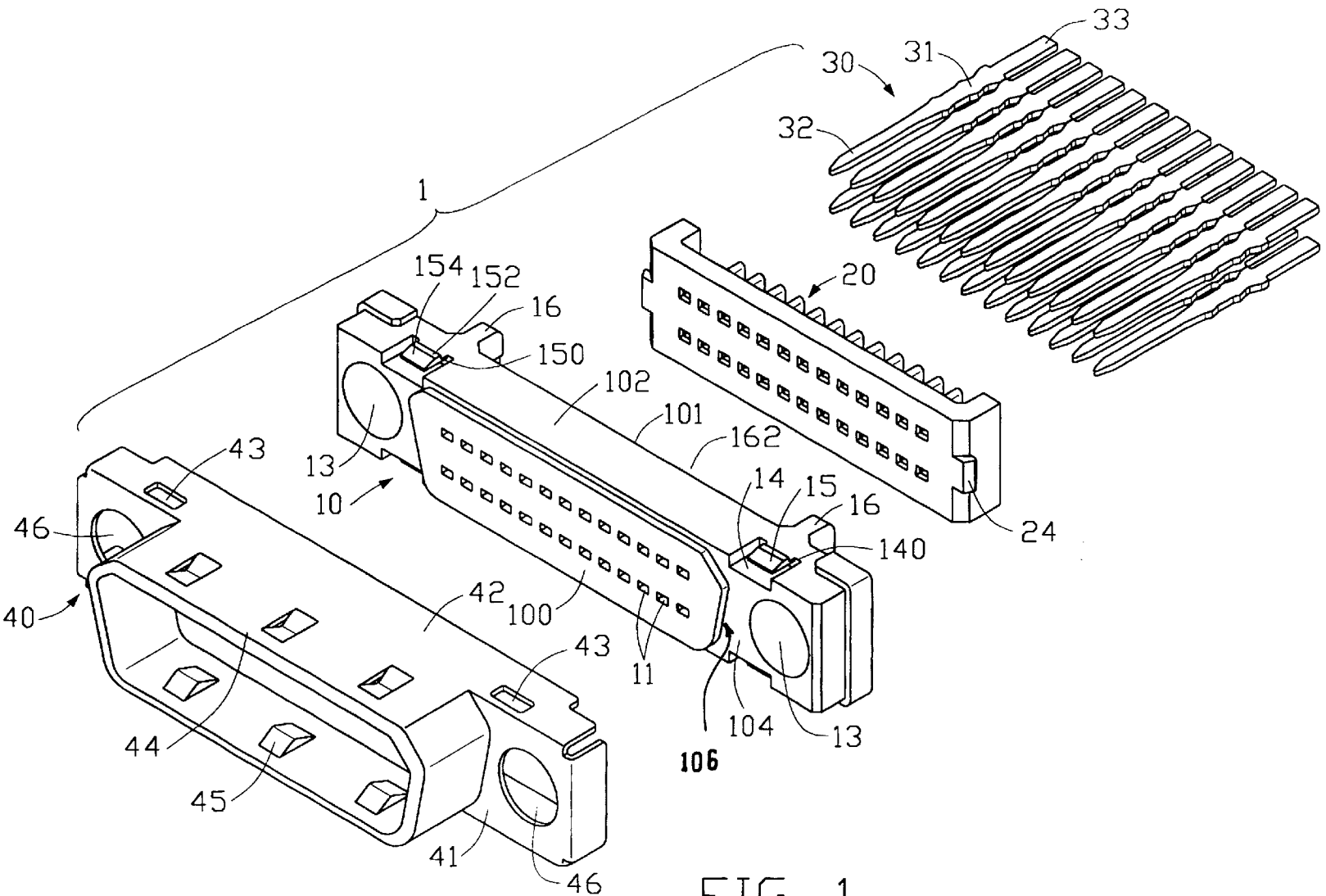
FIG. 1 is an exploded view of an electrical connector assembly in accordance with the present invention.

Referring to FIG. 1, an electrical connector assembly 1 in accordance with the present invention comprises an insulative housing 10 retaining a plurality of contacts 30 therein, a contact spacer 20 for positioning the contacts 30 and an outer shell 40 enclosing the housing therein.

The housing 10 is substantially elongate and has a main body 102 defining a mating face 100 and a rear face 101 opposite to the mating face 100. A plurality of receiving channels 11 is defined in the main body 102 between the mating face 100 and the rear face 101. A pair of positioning portions 104 laterally extends from opposite ends of the main body 102. A positioning hole 13 is defined in each positioning portion 104 for screwing means (not shown) to extend therethrough. A pair of projections 16 respectively extends rearward from the positioning portions 104 and defines a receiving space 162 therebetween for receiving the contact spacer 20.

A pair of recesses 14 is respectively defined in opposite sides of each positioning portion 104 of the housing 10 in communication with the mating face 100. A flexible hook 15 in a cantilever form extends integrally from each positioning portion 104 behind a corresponding recess 14 toward the mating face 100 so the flexible hook 15 is received in the corresponding recess 14. An inclined guiding section 154 is formed on a free end of each flexible hook 15 and a planar retaining section 152 is formed to a rear of the guiding section 154. The retaining section is located above a top face of the main body 102.

Each contact 30 forms a mating section 32 for electrically engaging with a mating connector (not shown), a retaining section 31 for being securely received in a corresponding receiving channel 11 of the housing 10, and a connecting section 33 for connecting with other electrical/electronic elements, such as a wire of a cable (not shown).

The contact spacer 20 is positioned within the receiving space 162 of the housing 10 and defines a plurality of positioning chambers 22 therethrough for positioning the corresponding contacts 3 therein. A pair of engaging projections 24 is formed on opposite ends of the contact spacer 20 for engaging with the housing 10.

The shell 40 has a main body 42 for enclosing the main body 102 of the housing 10 and a shroud 44 extending forward from a front face 41 of the main body 42. A plurality of projections 45 is inwardly formed on opposite upper and lower sides of the shroud 44 for engaging with an outer shield (not shown) of the mating connector. A pair of perforations 46 is respectively defined in the front face 41 on opposite lateral sides of the shroud 44 aligning with the corresponding positioning holes 13 of the housing 10. A pair of engaging openings 43 is defined in each of opposite upper and lower sides of the main body 42 corresponding to the flexible hooks 16 of the housing 10.

Figure 2:
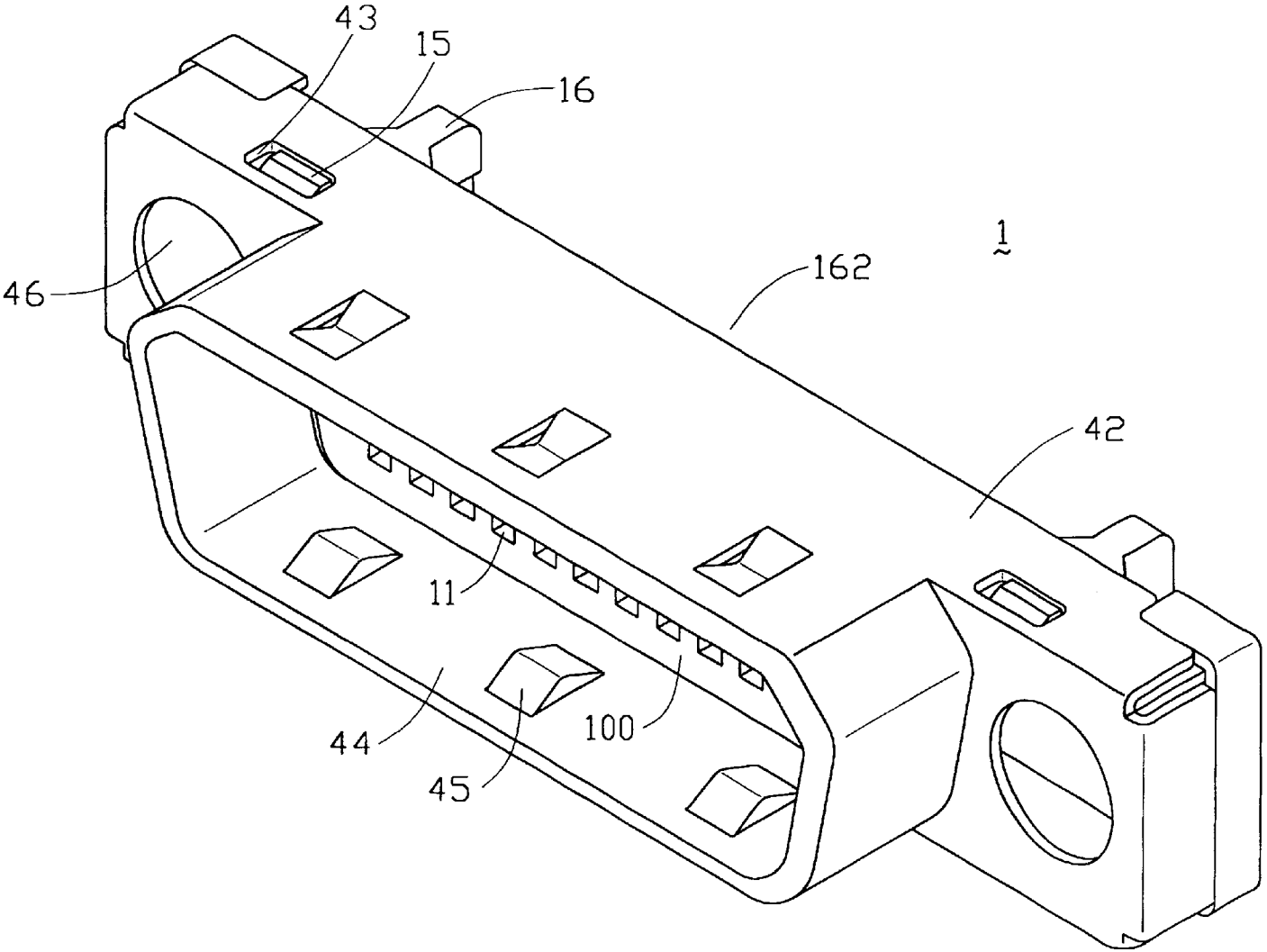
FIG. 2 is a partially assembled view of FIG. 1.
Figure 3:
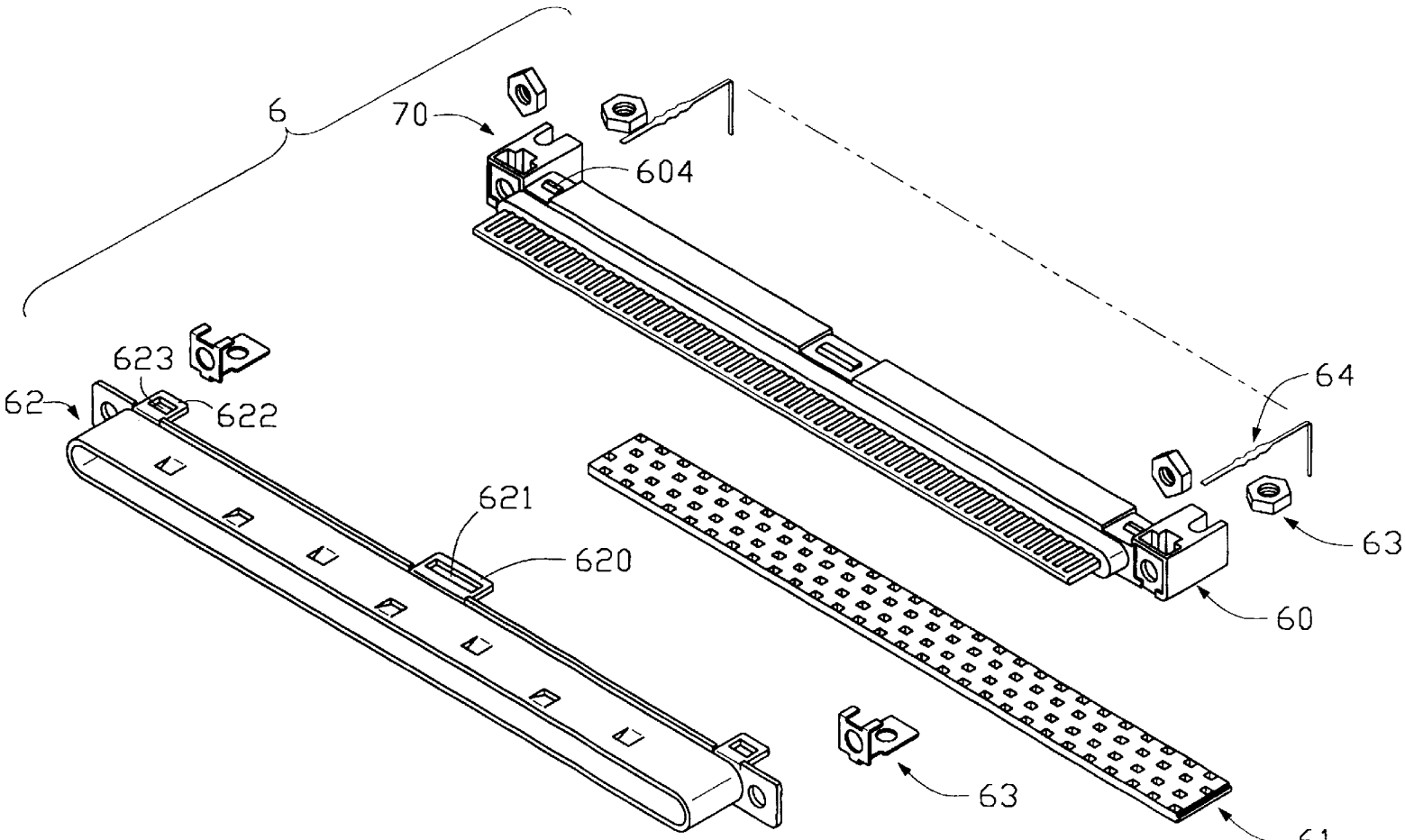
FIG. 3 (PRIOR ART)
FIG. 3 is an exploded view of a conventional connector assembly.

Referring further to FIG. 2 (although FIG. 2 only showing an assembly of the housing 10 and the shell 40, the assembling of the other parts, i.e., the contacts 30 and the spacer 20 being well known in the art), in assembly, the contacts 3 are first fixed in the housing 10. The retaining sections 31 of the contacts 3 are retained within the corresponding receiving channels 11 of the housing 10, the mating sections 32 forwardly extend outside the mating face 100 of the housing 10, and the connecting sections 33 extend rearward from the rear face 101 of the housing 10.

The contact spacer 2 is then positioned in the receiving space 162 of the housing 10. The connecting sections 33 of the contacts 3 are inserted through the corresponding positioning channels 22 of the contact spacer 2.

The shell 40 is assembled to the housing 10. The inclined guiding sections 154 are firstly depressed by the upper and lower sides of the main body 42 of the shell 40 whereby the flexible hooks 15 deflect toward the recesses 14. When the shell 40 reaches its final assembled position with the housing 10, the retaining section 152 of the flexible hooks 15 then snap into the corresponding engaging openings 43 of the shell 40 so that the shell 40 and the housing 10 are securely assembled together, in which the flexible hooks 15 recover to their original shape due to their resiliency. As in the present invention, the hooks 15 are flexible in nature, to assemble the shell 40 with the housing 10 does not need to adversely deflect the upper and lower sides of the main body 42 of the shell 40 upwards and downwards. Thus, the disadvantage of the prior art is overcome.

It is noted that the mating face 100 is formed on an island type protrusion 106 offset from the main body 102 in a front-to-back direction wherein the protrusion 106 is dimensioned to slightly project above the main body 102 and compliant with the configuration of the shroud 44 of the shell 40 for alignment between the shell 40 and the housing 10 when assembled, while without jeopardizing mating between the subject connector assembly 1 and the complementary mating connector (not shown).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A connector assembly comprising:

an insulative housing having a mating face, an opposite rear face and a plurality of receiving channels defined between the mating face and the rear face;

a plurality of contacts having retaining sections for engaging within corresponding receiving channels of the housing, and mating sections extending outside the mating face of the housing; and an outer metal shell for shielding the connector assembly, the shell forming a shroud for enclosing the mating sections of the contacts therein; wherein a pair of recesses are respectively defined in each one of two opposite sides of the housing in communication with the mating face, a cantilevered flexible hook being integrally formed with the housing in each recess and extending toward the mating face thereof, and the shell defines a pair of engaging openings in each one of two opposite sides thereof corresponding to the flexible hooks of the housing;

wherein each flexible hook forms a guiding section inclined toward the mating face of the housing for guiding the corresponding engaging opening of the shell to enter into engagement therewith;

wherein each flexible hook forms a retaining section connected with the guiding section for snapping into the corresponding engaging opening of the shell;

wherein a pair of ribs rearwardly extends from the housing and defines a receiving space therebetween;

further comprising a contact spacer positioned in the receiving space between the ribs of the housing.

* * * * *